United States Patent [19]

Masao

[11] 4,408,910

[45] Oct. 11, 1983

[54] INK RIBBON PROTECTING MECHANISM IN INK RIBBON CARTRIDGE

[75] Inventor: Sasaki Masao, Tokyo, Japan

[73] Assignee: Oki Electric Industry Co., Ltd., Tokyo, Japan

[21] Appl. No.: 323,258

[22] Filed: Nov. 20, 1981

[30] Foreign Application Priority Data

Nov. 25, 1980 [JP] Japan ..... 55-167411[U]

[51] Int. Cl.[3] ..... B41J 33/14

[52] U.S. Cl. ..... 400/207; 400/196.1

[58] Field of Search ..... 400/194, 195, 196, 196.1, 400/207, 208, 208.1, 674

[56] References Cited

U.S. PATENT DOCUMENTS

| | | | |
|---|---|---|---|
| 2,675,115 | 4/1954 | Jones | 400/674 |
| 3,294,228 | 12/1966 | Urso et al. | 400/208 |
| 3,726,381 | 4/1973 | Murphy | 400/196.1 |
| 3,833,108 | 9/1974 | Von Daeniken | 400/208 |
| 4,188,134 | 2/1980 | Garrido | 400/208 |
| 4,325,646 | 4/1982 | Sasaki | 400/196.1 |

OTHER PUBLICATIONS

IBM Technical Disclosure Bulletin, "Cartridge Shipping Tab," Froehlich et al., vol. 20, No. 1, Jun. 1977, p. 42.

*Primary Examiner*—Ernest T. Wright, Jr.

*Attorney, Agent, or Firm*—Berger & Palmer

[57] ABSTRACT

Disclosed is an ink ribbon protecting mechanism for preventing jamming of an ink ribbon which is contained in a folded state in an ink ribbon cartridge comprising a case member and a lid member. An ink ribbon contained in such ribbon cartridge is brought down or twisted by vibration or shock during transportation or the like, which results in occurrence of jamming of the ink ribbon during use. Occurrence of jamming is effectively prevented by this ink ribbon protecting mechanism.

The protecting mechanism comprises a protecting member including a plurality of needle-like or plate-like projections formed on a substrate, and these projections are inserted into through holes formed on the outer wall of a ribbon cartridge and intruded among laps of the folded ink ribbon. The ink ribbon is supported by these projections and is thus prevented from being folded or brought down or twisted by vibration or shock during transportation or the like.

4 Claims, 7 Drawing Figures

INK RIBBON PROTECTING MECHANISM IN INK RIBBON CARTRIDGE

BACKGROUND OF THE INVENTION (1) Field of the Invention

The present invention relates to an ink ribbon cartridge to be used in a printer. More particularly, the present invention relates to an ink ribbon protecting mechanism of an ink ribbon cartridge which prevents an ink ribbon contained in the ink ribbon cartridge from being brought down or twisted by vibration or shock caused during transportation or the like.

(2) Description of the Prior Art

In an ink ribbon cartridge to be used for a printer, an ink ribbon is folded at a predetermined pitch and contained in this folded state, and the contained ink ribbon is delivered out in succession by a feeding mechanism and used for the printing operation. An ink ribbon cartridge of this type ordinarily comprises a case member having in the interior thereof a container portion having a depth substantially equal to the width of the ink ribbon and also having an ink ribbon inlet and outlet and a lid member integrally associated with the case member. As such an ink ribbon cartridge, there can be mentioned one previously proposed by me in U.S. patent application Ser. No. 119,831 filed Feb. 8, 1980, now U.S. Pat. No. 4,325,646 issued Apr. 20, 1982. In this ink ribbon cartridge, both the case member and the lid member are constructed by thin molded articles of a synthetic resin, and both the side plates of the case member are supported by anchoring pawls formed on the lid member to prevent deformation thereof, and by securing the anchoring pawls to the case member, deformation of the lid member is prevented. By co-operation of such case member and lid member, a high rigidity is maintained in the ink ribbon cartridge though it is formed of a thin molded articles, and this ink ribbon cartridge is economically advantageous.

In the ink ribbon cartridge having the above-mentioned structure, the interior is quite hollow and empty, and there is disposed no member for supporting an ink ribbon folded at a predetermined pitch and contained in the interior of the ink ribbon cartridge. Accordingly, the ink ribbon is often brought down or twisted by vibration or shock during transportation or the like. There may be considered a method in which supporting members such as projections are formed in the interior of the ink ribbon cartridge and an ink ribbon is supported by such supporting members. However, if projections are formed in the interior of the ink ribbon cartridge, these projections hinder smooth travel of the ink ribbon when the printer is driven and the printing operation cannot be performed conveniently.

SUMMARY OF THE INVENTION

The ink ribbon protecting mechanism of the present invention is characterized in that a protecting member comprises a plate-like substrate and a plurality of needle-like or plate-like projections formed on the substrate, through holes are formed on the outer wall, including top and bottom faces, of an ink ribbon cartridge which comprises a case member and a lid member, and in that when the ink ribbon cartridge is not actually used, for example, during transplantation, the projections of the protecting member are inserted in these through holes and intruded among laps of an ink ribbon folded in the ink ribbon cartridge, whereby the ink ribbon is supported by the projections of the protecting member.

It is therefore a primary object of the present invention to provide an ink ribbon protecting mechanism in which when an ink ribbon cartridge is not actually used, projections of a protecting member are inserted into through holes of the ink ribbon cartridge to support an ink ribbon and prevent it from being brought down or twisted and when the ink ribbon cartridge is actually used, the protecting member is removed from the ink ribbon cartridge to ensure smooth feeding of the ink ribbon.

Another object of the present invention is to provide an ink ribbon protecting mechanism in which a protecting member is formed so that it can easily be detached from an ink ribbon cartridge. This protecting member is attached to the ink ribbon cartridge when there is a risk of falling or twisting of an ink ribbon and this protecting member can easily be removed from the ink ribbon cartridge when the ink ribbon cartridge is actually used.

Still another object of the present invention is to provide an ink ribbon protecting mechanism in which a protecting member is constructed by a cheap molded article of a synthetic resin and it is discarded after it has been used.

These and other objects and novel features of the present invention will more fully appear from the following detailed description when the same is read in connection with the accompanying drawing. It is to be understood, however, that the drawing is for the purpose of illustration only and is not intended as a definition of the invention.

DETAILED DESCRIPTION OF THE PREFERRED EMBODIMENTS

Figure 1:
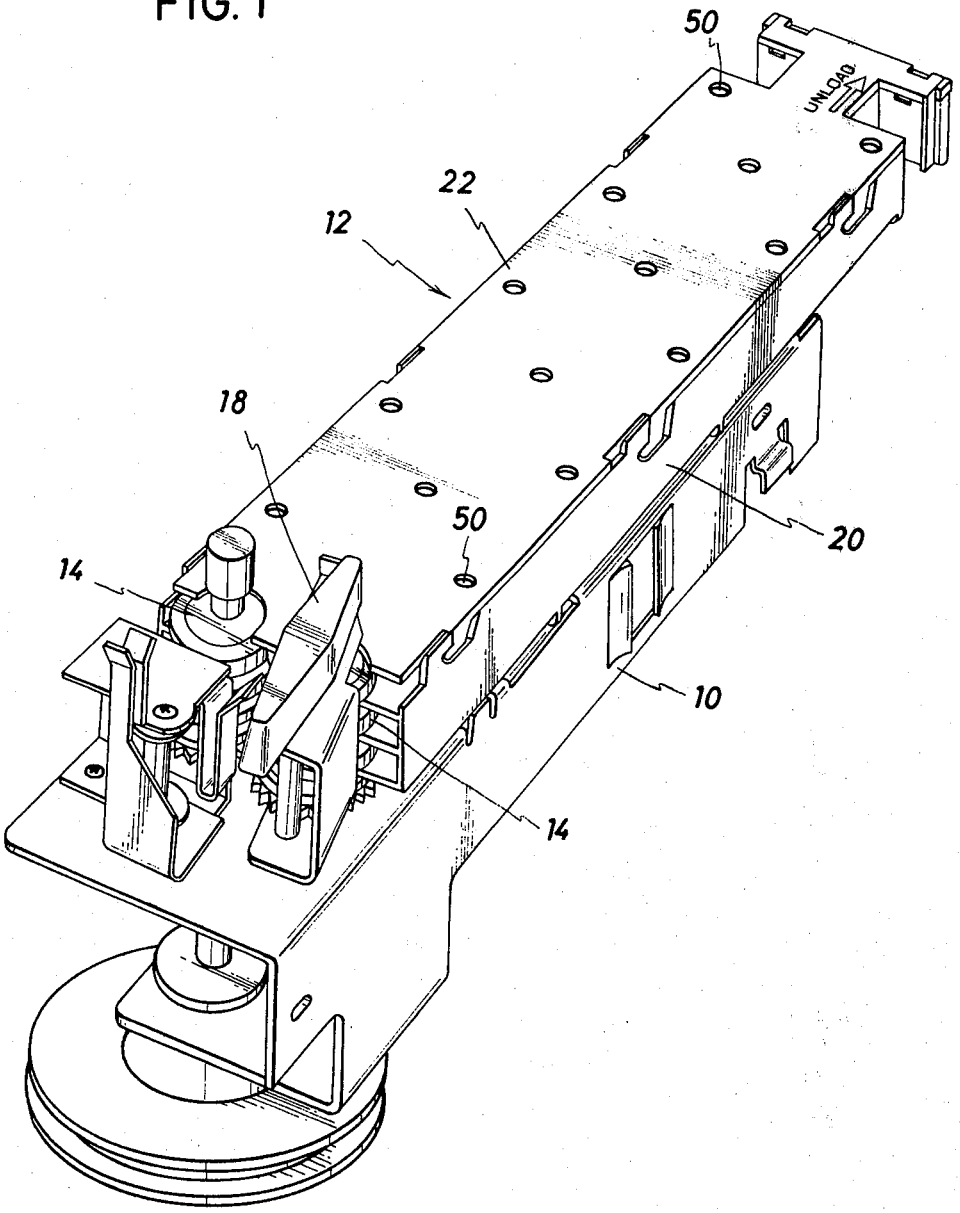
FIG. 1 is a perspective view illustrating the state where the ink ribbon cartridge of the present invention is attached to an external feeding mechanism.

FIG. 1 illustrates one embodiment of the ink ribbon cartridge of the present invention, which is mounted on a feeding mechanism of a dot matrix line printer.

In the dot matrix line printer, a plurality of printing elements are arranged perpendicularly to the surface of printing paper, and the printing paper and an ink ribbon are positioned between a platen and the printing elements and the printing elements are driven to press the ink ribbon to the printing paper and effect printing line by line.

In FIG. 1, reference numeral 10 represents a base of the feeding mechanism, and an ink ribbon cartridge 12 is mounted on the base 10. A drive roller 14 is disposed to draw an endless ink ribbon 16 into the ink ribbon cartridge 12, and a set lever 18 is disposed to effect attachment and dismounting of the ink ribbon cartridge 12.

The ink ribbon cartridge 12 comprises a case member 20 and a lid member 22 which are integrated with each other, and the endless ink ribbon 16 is contained in the interior of the ink ribbon cartridge 12 and in this state the ink ribbon cartridge 12 is mounted on the base 10.

In the dot matrix line printer, one line is printed at a time. Accordingly, the ink ribbon 16 should have a length longer than the printing width for one line. Furthermore, in order to ensure a sufficient life for the ink ribbon, an appropriate length is necessary for the ink ribbon. Therefore, the ink ribbon cartridge 12 should have a size large enough to contain therein the ink ribbon 16 having such sufficient length.

Figure 2:
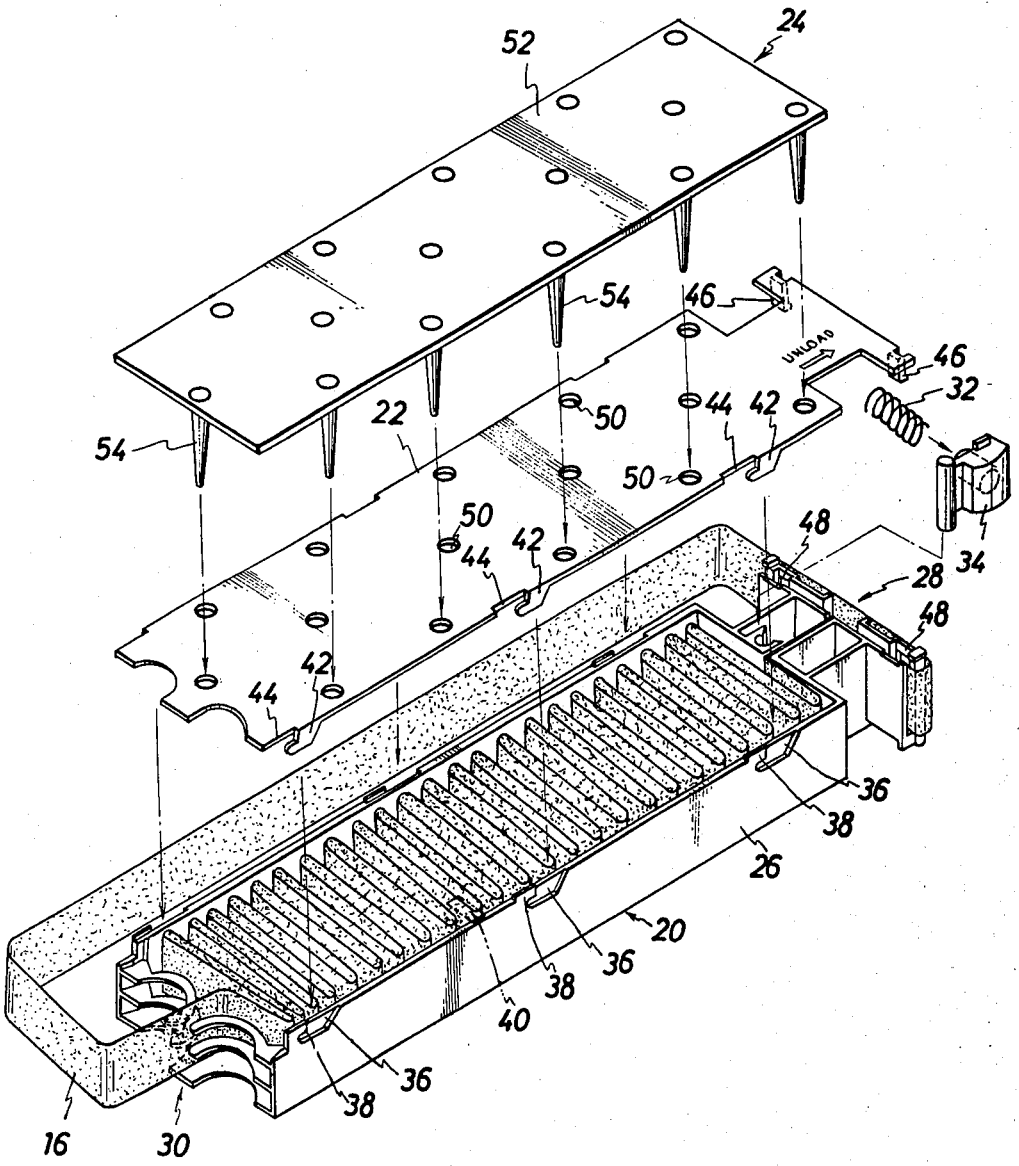
FIG. 2 is a fragmentary perspective view illustrating one embodiment of the ink ribbon protecting mechanism in the ink ribbon cartridge according to the present invention.

FIG. 2 illustrates the state where the ink ribbon cartridge 12 is disassembled into the case member 20 and the lid member 22. As is seen from FIG. 2, the ink ribbon cartridge 12 comprises the case member 20, the lid member 22 and a dismountable protecting member 24. In the interior of the case member 20, a space for containing the ink ribbon 16 is defined by wall members 26, and the ink ribbon 16 is folded at a predetermined pitch and contained in the case member 20 in this folded state between an outlet 28 formed on one end of the case member 20 in the longitudinal direction thereof and an inlet 30 formed on the side, to be fitted in the drive rollers 14, of the case member 20.

A frictional drag member 34 rotatable with the one end being as the center and urged against the ink ribbon 16 by a spring 32 is mounted on the outlet 28, so that a tension is given to the ink ribbon 16 outside the case member 20 by the frictional drag member 34 and the endless ink ribbon 16 is caused to confront the platen and printing paper (not shown) under certain tension. The method for drawing out the ink ribbon 16 is not limited to the one shown in the drawing, and many other methods may be adopted for drawing out the ink ribbon 16.

A plurality of pairs of fitting concavities 36 and anchoring projections 38 are arranged at predetermined intervals on the upper portion of the outer surface of the wall member 26 of the case member 20. Cuts 40 to be engaged with the pawls of the base 10 are formed on the outer bottom of the case member 20.

The lid member 22 has a plate-like shape, and a plurality of pairs of anchoring pawls 42 to be engaged with the fitting concavities 36 of the case member 20 and notches 44 to be engaged with the anchoring projections 38 of the case member 20 are formed on both the sides of the lid member 22 at the same intervals as those of the fitting concavities 36 and the anchoring projections 38. The anchoring pawls 42 hang down to both the side ends of the lid member 22 and they exert a function of supporting the wall member 26 of the case member 20 so that when the pawls 42 are engaged with the fitting concavities 36 of the case member 20, the wall member 26 of the case member 20 is prevented from being expanded. More specifically, the anchoring pawls 42 push inwardly the wall member 26 which is readily deformed outwardly, whereby outward deformation of the wall member 26 is prevented. Notches 44 are arranged so that they are engaged with the corresponding anchoring projections 38. When the anchoring projections 38 are fitted in the notches 44, they exert a function of pushing outwardly the wall member 26. Namely, the wall member 26 which is going to be deformed inwardly is pushed outwardly and inward deformation of the wall member 26 is prevented. The top ends of the anchoring projections 38 are set at the same level as that of the top surface of the lid member 22. Reference numerals 46 and 48 represent a pawl and engaging hole forming a locking means for preventing the movement of the lid member 22 in the reverse direction when the lid member 22 is fitted to the case member 20, and this looking means 46,48 is located on the end portion of the ink ribbon cartridge 12 on the side where the outlet 28 is located. A plurality of through holes 50 are formed on the lid member 22 having the above-mentioned structure.

The protecting member 24 comprises a substrate 52 having substantially the same size as that of the lid member 22 and a plurality of needle-like projections 54 formed on the substrate 52. These projections 54 are located at such positions that they are engaged with the corresponding through holes 50 of the lid member 22, amd the length of the needle-like projections 54 is adjusted so that when they are inserted into the through holes 50 of the lid member 22, they do not reach the bottom of the case member 20.

The above-mentioned case member 20, lid member 22 and protecting member 24 are formed by molding a plastic material, for example, an ABS resin (acrylonitrile-butadiene-styrene copolymer resin).

Figure 4:
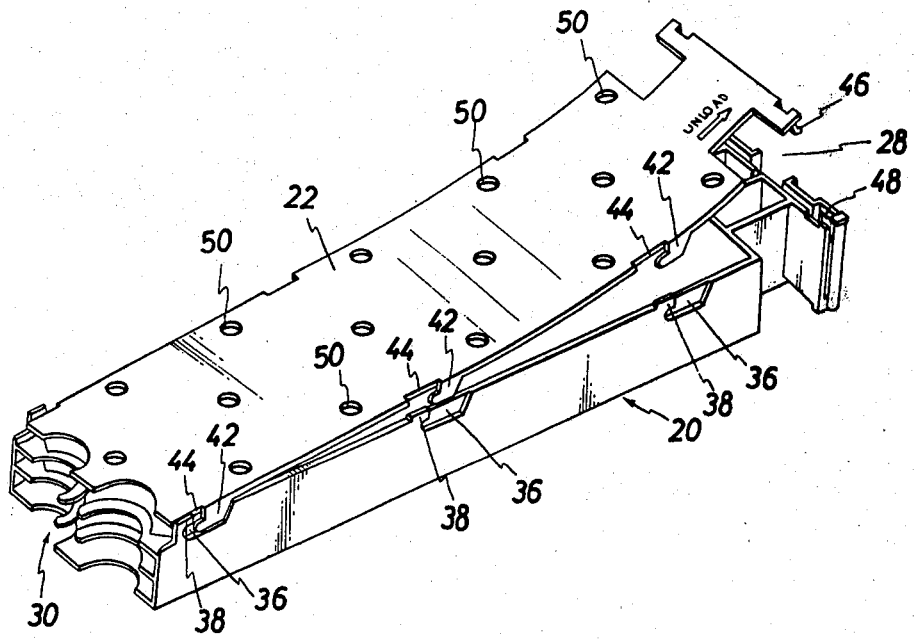
FIG. 4 is a perspective view illustrating the state where a lid member is attached to a case member.

The operation of the ink ribbon cartridge 12 of the present invention having the above-mentioned structure will now be described with reference to FIG. 4.

In order to associate the lid member 22 with the case member 20, the anchoring pawls 42 are inserted into the fitting concavities 36 at positions slightly deviated from the predetermined positions, and the lid member 22 is guided by the anchoring pawls 42 and slid in the longitudinal direction, that is, from the outlet 28 toward the inlet 30 in this embodiment. Thus, the anchoring pawls 42 are engaged with the fitting concavities 36 and the anchoring projections 38 are engaged with the notches 44, and by a plurality of these anchoring means, the lid member 22 is attached to the case member 20 without any play in the horizontal direction. Then, the pawl 46 of the locking means 46,48 is inserted in the anchoring hole 48 of the locking means, whereby the movement of the lid member 22 in the reverse direction is prevented and the lid member 22 is integrally associated with the case member 20. Thus, the ink ribbon cartridge 12 is constructed.

Figure 3:
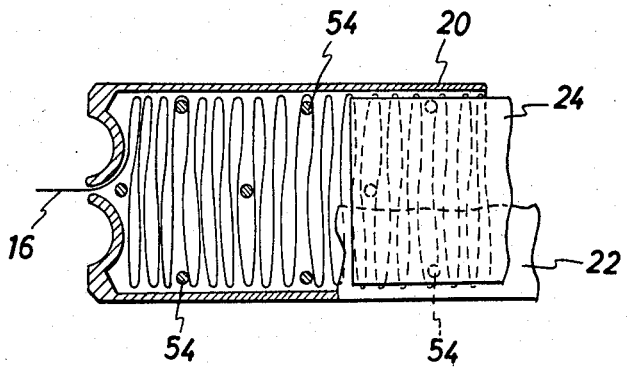
FIG. 3 is a partially cut-out, partially sectional plan view of the embodiment shown in FIG. 2.

In a manufacturing plant, an endless ink ribbon 16 as shown in FIG. 3 is contained in the so-constructed ink ribbon cartridge 12 in the state where the ink ribbon 16 is folded at a predetermined pitch. When the ink ribbon cartridge 12 having the ink ribbon 16 thus stored therein is transported, the projections 54 of the protecting member 24 are inserted into the through holes 50 and the projections 54 are intruded among laps of the folded ink ribbon 16 gradually from the top end portions thereof. Thus, the ink ribbon 16 is prevented from being folded or brought down or twisted by vibration or shock during transportation.

When the ink ribbon cartridge 12 is actually used, the cut 40 of the outer bottom of the case member 20 is engaged with the pawl of the base 10 to secure the ink ribbon cartridge 12 to the base 10, and the protecting member 24 is pulled out and the ink ribbon 16 is circulated by the feeding mechanism and used repeatedly.

Figure 5:
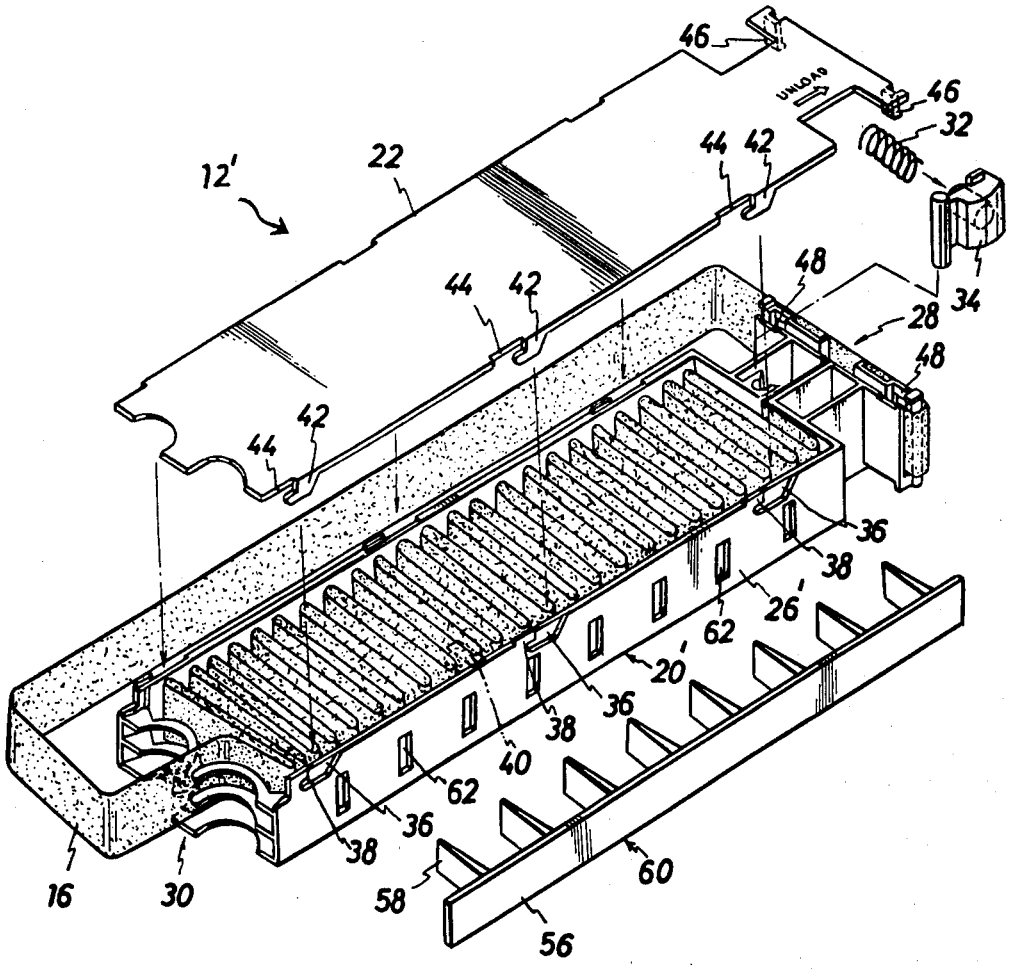
FIG. 5 is a fragmentary perspective view illustrating another embodiment of the ink ribbon protecting mechanism according to the present invention.
Figure 6:
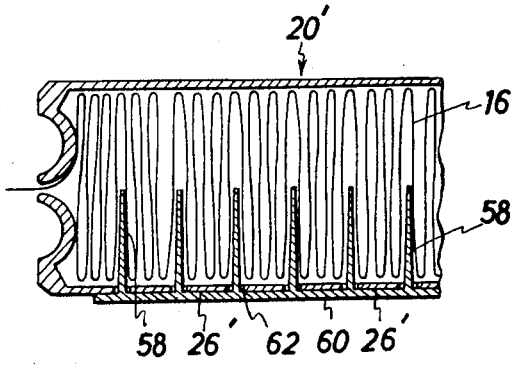
FIG. 6 is a partially sectional plan view of the embodiment shown in FIG. 5.

Another embodiment of the present invention is shown in FIGS. 5 and 6. In this embodiment, a plurality of plate-like projections 58 are formed on a substrate 56 to construct an auxiliary member 60, and long through holes 62 to receive the projections 58 of the auxiliary member 60 are formed on one wall member 26' of the case member 20'. When the ink ribbon cartridge 12' having the ink ribbon 16 stored therein as in the foregoing embodiment is transported, the projections 58 of the auxiliary member 60 are inserted into the through holes 62 and intruded among laps of the ink ribbon 16 folded in the ink ribbon cartridge 12', whereby falling or twisting of the ink ribbon 16 can be prevented as in the foregoing embodiment.

Figure 7:
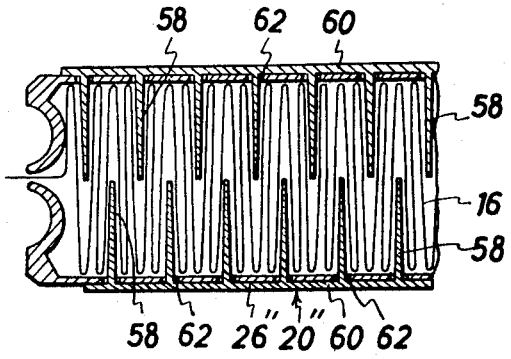
FIG. 7 is a partially sectional plan view illustrating still another embodiment of the ink ribbon protecting mechanism according to the present invention.

Still another embodiment of the present invention is illustrated in FIG. 7. In this embodiment, through holes 62 are formed as both the wall members 26'' of the case member 20'', and the projections 58 of the auxiliary member 60 similar to that of the embodiment shown in FIG. 5 can be inserted into the through holes 62 of both the wall members 26'' and intruded among laps of the folded ink ribbon 16. In this embodiment, the through holes 62 on one wall member 26'' may be arranged at positions opposite the corresponding through holes 62 on the other wall member 26'', but as shown in FIG. 7, the through holes 62 on one wall member 26'' are preferably staggered by half a pitch from the through holes 62 on the other wall member 26''. It is preferred that the length of the projections 58 be adjusted so that they reach the central portion of the case member 20''. Of course, the length of the projections 58 may be longer or shorter. Also in the embodiment shown in FIG. 7, by inserting the auxiliary member 60, falling or twisting of the ink ribbon 16 can be prevented during transportation.

In all of the foregoing embodiments, since falling or twisting of the ink ribbon 16 can effectively be prevented during transportation, jamming of the ink ribbon 16 can be prevented when the ink ribbon cartridge 12 and 12' is actually used.

Incidentally, needless to say, in the embodiments shown in FIGS. 5 and 7, through holes 50 need not be formed on the lid member 22.

While there have been described and shown the fundamental embodiments of the invention, it will be understood that various omissions, substitutions and changes may be made by those skilled in the art without departing from the scope of the invention.

What is claimed is:

1. In an ink ribbon cartridge for a printer for containing therein an endless ink ribbon and successively feeding the ink ribbon for a printing operation by a feeding mechanism of the printer, a case member including wall members and having in the interior thereof an ink ribbon-storing portion having a depth substantially equal to the width of the ink ribbon and also having an inlet and an outlet for the ink ribbon and a plate-like lid member integrally associated with said case member; an ink ribbon protecting mechanism comprising through holes formed on said cartridge and an auxiliary member comprising a substrate and projections formed on the substrate, said projections corresponding to the interval and shape of said through holes, the projections of the auxiliary member being inserted in said through holes to intrude among laps of the ink ribbon in its folded state contained in the ink ribbon cartridge to thereby prevent falling or twisting of the ink ribbon during transportation.

2. An ink ribbon protecting mechanism as set forth in claim 1, wherein a plurality of said through holes are formed on the lid member, said auxiliary member substrate and projections comprising a plate-like substrate having substantially the same size and shape as said lid member and a plurality of needle-like projections formed at the same intervals as those of said through holes.

3. An ink ribbon protecting mechanism as set forth in claim 1, wherein said through holes are formed on at least one of the wall members of the case member, said auxiliary member substrate and projections comprising at least one strip and a plurality of plate-like projections connected to said strip to be engaged with said through holes, and said projections of the protecting mechanism being inserted into said through holes while the ink ribbon cartridge is transported.

4. An ink ribbon protecting mechanism as set forth in claims 1 or 3, wherein said through holes are formed on opposite side walls of the case member at staggered half pitch distances with respect to each other, and said auxiliary member substrate and projections comprises two strips and corresponding plate-like projections.

* * * * *